US005707285A

United States Patent [19]

Place et al.

[11] Patent Number: 5,707,285

[45] Date of Patent: Jan. 13, 1998

[54] METHOD AND APPARATUS FOR RANDOM PRIZE SELECTION IN WAGERING GAMES

[76] Inventors: Vaughn Place, 1120 E. Crystal Canyon Ct., Reno, Nev. 89505; Brad Johnson, 6034 Plumas St., Apt. F, Reno, Nev. 89509

[21] Appl. No.: 761,492

[22] Filed: Dec. 6, 1996

Related U.S. Application Data

[60] Provisional application No. 60/014,657, Apr. 2, 1996.

[51] Int. Cl.[6] ..... A63F 1/00

[52] U.S. Cl. ..... 463/12; 273/292

[58] Field of Search ..... 463/11, 12, 22; 273/292, 309

[56] References Cited

U.S. PATENT DOCUMENTS

| | | | |
|---|---|---|---|
| 4,861,041 | 8/1989 | Jones et al. | 273/292 |
| 5,078,405 | 1/1992 | Jones et al. | 273/309 |
| 5,098,107 | 3/1992 | Boylan et al. | 273/309 X |
| 5,280,915 | 1/1994 | Groussman | 273/292 |
| 5,288,077 | 2/1994 | Jones | 273/292 |
| 5,328,189 | 7/1994 | Maiek | 273/292 |
| 5,330,185 | 7/1994 | Wells | 463/22 X |
| 5,364,104 | 11/1994 | Jones et al. | 273/292 |
| 5,377,973 | 1/1995 | Jones et al. | 273/292 X |
| 5,393,067 | 2/1995 | Paulsen et al. | 273/292 |
| 5,413,353 | 5/1995 | Demarest et al. | 273/292 |
| 5,417,430 | 5/1995 | Breeding | 273/292 |
| 5,437,462 | 8/1995 | Breeding | 273/292 |

*Primary Examiner*—William H. Grieb
*Attorney, Agent, or Firm*—Ian F. Burns, Esq.

[57] ABSTRACT

A wagering game apparatus and method is provided which permits the random selection of prizes for games such as blackjack, poker, and electronic games. A side wager is placed in a receptacle or designated area which indicates to the dealer that the player wishes to participate in the random jackpot selection portion of the game. If a random event occurs, such as the player being dealt a preselected combination of cards, the player or dealer may activate the random prize selection process. The random prize selection is performed by a computer which uses a random generated number to select a prize from a pay table. The prize may be displayed on or near the gaming table. The player is then awarded the random jackpot amount.

16 Claims, 3 Drawing Sheets

METHOD AND APPARATUS FOR RANDOM PRIZE SELECTION IN WAGERING GAMES

CROSS REFERENCES TO RELATED APPLICATIONS

This application claims priority of provisional patent application number 60/014,657, filed on Apr. 2, 1996.

BACKGROUND OF THE INVENTION

1. Field of Invention

The present invention relates to a method and apparatus for randomly selecting a jackpot or prize which may be used with card games, video games, and other wagering games.

2. Description of Related Art

The creation of large jackpots with slot machines is well known and relatively easy to accomplish because of the large number of such machines which are in operation and the ease with which these machines can be electronically linked. The large jackpots are generated by accumulating a portion of each bet placed in each machine on the system and establishing sufficiently low odds for winning the jackpot that the likelihood of winning the jackpot on any single game is extremely small. The electromechanical character of the machines and the absence of an intervening dealer participating in the game makes it relatively easy to generate large jackpots such as $1,000,000.

The same is not true for live card games. Such games are neither mechanically nor electrically controlled, but are played with a dealer who represents the house (casino). This increases the difficulty of retaining a portion of the bets placed during the games and accumulating them in a jackpot, along with determining the necessary high odds against winning the jackpot. Large jackpots cannot be awarded on common card combinations, such as blackjacks, because the odds of occurrence of these combinations are relatively low. Furthermore, in traditional live card games the dealer would be responsible for determining when a player has a jackpot winning hand. This further complicates the setup and generation of truly large jackpots.

As a result, traditional live card games cannot match the large size of jackpots that can be won when playing mechanical or video slot machines. Even though live card games are very popular, they are incapable of generating large jackpots. The player never has an opportunity to win large sums of money comparable to the multi-million dollar jackpots that are frequently paid out by casinos participating in systems made up of thousands or tens of thousands of slot machines all of which pay a percentage of their bets into a common jackpot pool.

The present invention seeks to enhance the attractiveness of live card games and to provide greater player satisfaction by providing a means to modify the live card games so that large prizes can be won. The present invention also provides a means for players to participate in the process by which the prize is selected or generated.

The present invention contains two primary components that the prior art U.S. Pat. Nos. 5,437,462, 5,413,353, 5,280,915 and 5,078,405, as well as other casino games do not utilize, that is random jackpot or prize selection and an electronic sign to display the mount of such a jackpot. All other games only reference various elements of the invention displaying jackpots, and/or requiring a preselected combination of cards to win the jackpot. These games significantly diverge away from this invention in that their jackpots and payoffs are based on progressive or fixed payoffs in contrast to the present invention that randomly selects a payoff according to a predetermined random number generating algorithm. Furthermore, these games do not provide a means by which a player may physically participate in the prize or jackpot selection of the game. Other advantages of the present invention over the prior art also will be rendered evident.

SUMMARY OF INVENTION

1. Objects of the Invention

It is therefore an object of the present invention to provide a new and improved method and apparatus for generating large random jackpots on live card tables and video screens which has all of the advantages of the prior art and none of the disadvantages.

It is another object of the present invention to provide a new and improved method and apparatus for generating large random jackpots on live card tables and video screens which may be easily and efficiently manufactured and marketed.

It is a further objective of the present invention to provide a new and improved method and apparatus for generating large random jackpots on live card tables and video screens which is durable and reliable.

An even further object of the present invention is to provide a new and improved method and apparatus for generating large random jackpots on live card tables and video screens which is economical to manufacture.

Still a principal object of the present invention is to provide a new and improved method and apparatus for generating large random jackpots on live card tables and video screens wherein the jackpot or prize is generated randomly by a computer when the dealer or player indicates to the machine that one or more specific card combinations or other chance events have been dealt or occurred.

It is still a further object of the present invention to provide a new and improved method and apparatus for generating large random jackpots on live card tables and video screens wherein the jackpot amount won is displayed prominently at or near the table where the game is being played.

Still a further object of the present invention is to provide a new and improved method and apparatus for generating large random jackpots on live card tables and video screens including means for the players in the game to indicate their willingness to play for an additional prize by placing a coin or chip in a designated area or receptacle.

It is still a further object of the present invention to provide a means for recording and monitoring wagers which are placed to participate in the jackpot or prize portion of the game.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

2. Brief Description of the Invention

To achieve the foregoing and other advantages, the present invention, briefly described, provides an apparatus and method to randomly select jackpots or prizes for live card games, such as blackjack, as well as electronic games.

A side wager is placed in a receptacle or designated area which indicates to the dealer that the player wishes to participate in the random jackpot selection. If a predetermined event occurs, such as the player being dealt a preselected combination of cards, the dealer or player may activate the selection device. The jackpot may be money, a tangible prize, such as an automobile or a service, such as a restaurant voucher. The jackpot or prize may be displayed on or near the gaming table. The player is then awarded the random jackpot amount.

The present invention is adapted to be played with a large variety of games without significantly changing the way the underlying game is played. The present invention may be added to the underlying game without changing the rules and it does not require players to relearn the basic rules of the game. In the preferred embodiment, the present invention is used with 21 or blackjack card game and the predetermined event is the player receiving a blackjack. The selection is a button or plunger type switch.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining at least one preferred embodiment of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The invention will be better understood and the above objects as well as objects other than those set forth above will become more apparent after a study of the following detailed description. Such description makes reference to the annexed drawings wherein.

REFERENCE NUMERALS

Figure 1:
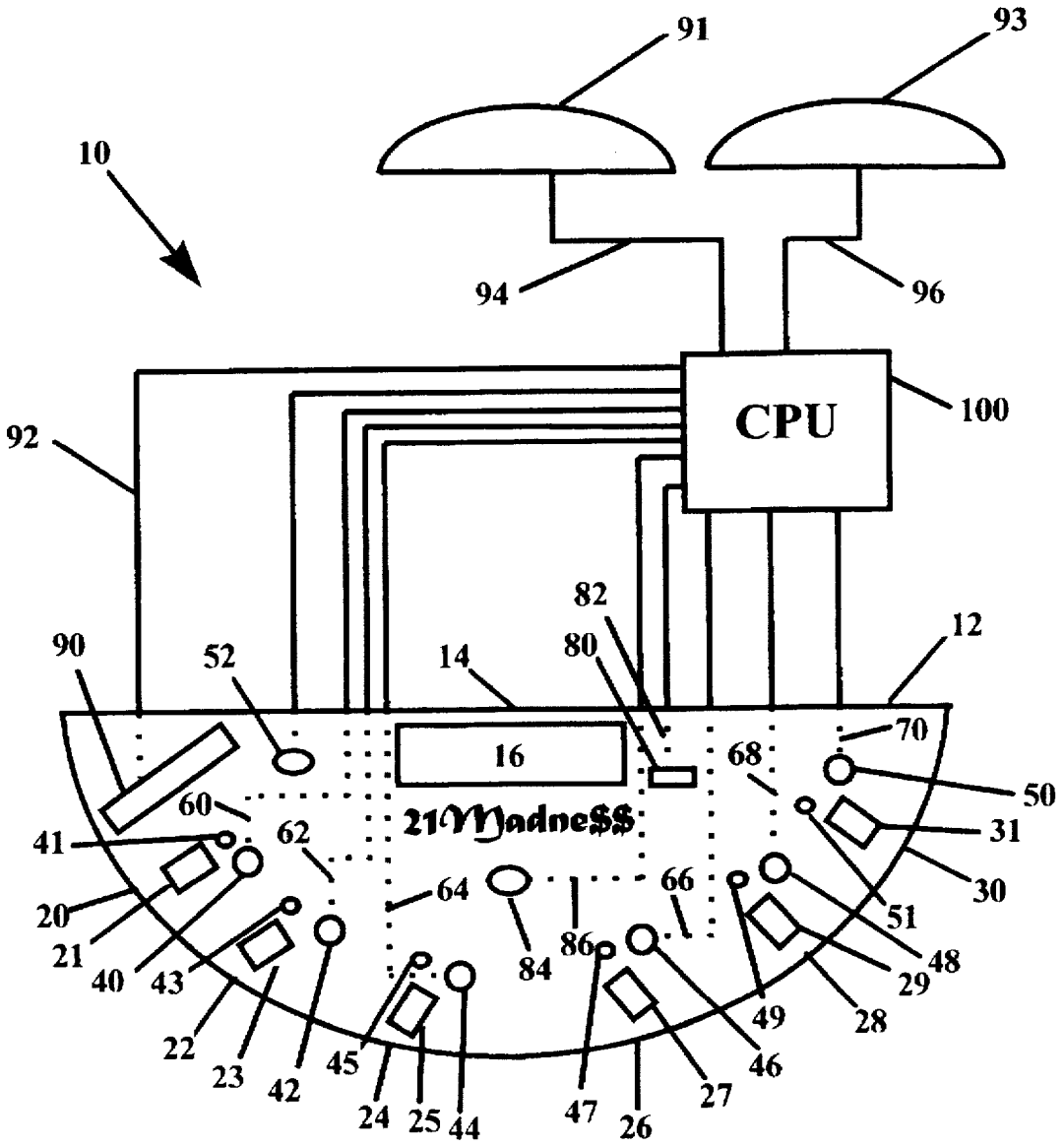
FIG. 1 is a schematic view of the apparatus of the present invention.

10 preferred embodiment
12 table
14 dealer position
16 coin tray
20 player position
21 card region
22 player position
23 card region
24 player position
25 card region
26 player position
27 card region
28 player position
29 card region
30 player position
40 side wager receptacle
41 confirmation light
42 side wager receptacle
43 confirmation light
44 side wager receptacle
45 confirmation light
46 side wager receptacle
47 confirmation light
48 side wager receptacle
49 confirmation light
50 side wager receptacle
51 confirmation light
52 central indicator light
60 connective wire means
62 connective wire means
64 connective wire means
66 connective wire means
68 connective wire means
70 connective wire means
80 dealer activation means
82 connecting wire means
84 switch button
86 connective wire means
90 prize display table
92 connection wire means
92 table
94 connective wire means
96 connective wire
100 CPU
150 method step
152 method step
154 method step
156 method step
158 method step
160 method step
162 method step
164 method step
166 method step
200 method step
202 method step
204 method step
206 method step
208 method step
210 method step
212 method step
213 method step
214 method step
216 method step

DESCRIPTION OF THE PREFERRED EMBODIMENT

With reference now to the drawings, a new and improved method and apparatus for generating large random jackpots on live card tables and video screens embodying the principles and concepts of the present invention will be described.

Turning initially to FIG. 1, there is seen a schematic representation of the preferred embodiment of the present invention indicated at 10. In this embodiment, the game of chance that is being enhanced or supplemented is the common game of blackjack, also known as "21" or "vingt-et-un". However, it is realized that many other games, such as poker, may be adopted to be played with the present invention. The table 12 for playing this game commonly holds places for six players at player positions 20, 22, 24, 26, 28, and 30. Of course, these places are not always filled, and players come and go. A dealer position 14 may be included with a coin tray 16 for storing coins, tokens or chips.

In the embodiment described herein, the game is being played in a casino environment, and the instant invention is particularly well adapted to this environment in that the display (discussed further hereinbelow) may be used to attract players to the table. The actual mechanics of the game of blackjack are well known and the rules and procedures of the game will not be discussed in any detail other than to note that it is contemplated that each table incorporating the present invention may use multiple or single decks of cards: in the preferred embodiment the number of decks would be three.

At each playing position 20, 22, 24, 26, 28, and 30, there is a corresponding card region 21, 23, 25, 27, 29, and 31, respectively, for receiving playing cards and a corresponding side wager receptacle or area 40, 42, 44, 46, 48, and 50, respectively. In this exemplary embodiment described herein, the receptacles are connected to CPU 100 through connective wiring indicated at 60, 62, 64, 66, 68, and 70, respectively. The receptacles could have some sort of indicator means, such as an electromechanical switch, optical switch or infrared switch, for indicating the presence of a coin or token to CPU 100. This allows CPU 100 to record and monitor wagers placed in the wager receptacles. It is recognized that no receptacle may be provided and a silk screened pattern, as is common in the industry, may be provided to receive the side wagers. Any value token, chip, or coin may be required by the rules of a particular game for a player to indicate his participation in the prize selection portion of the game. This wager is defined as a side or prize wager and it may be optional or required for all players. It should be noted that confirmation lights 41,43,45,47,49 and 51 or some other type of signal could be given to indicate that the player's wager is recognized by CPU 100. A central indicator light 52 may be included to indicate that the random selection program is set and ready for the next game. Alternatively, the dealer, located at dealer position 14, could note the coin or token placed in a receptacle visually, and notify the CPU 100 through dealer/CPU activation means 80 and its corresponding connecting wire means 82. In any case, no more side wagers would be allowed to be made once the cards have begun to be dealt.

CPU 100 may be used with multiple tables as indicated by simplified tables 91 and 93. These tables are connected to CPU 100 through wire means 94 and 96. A well-known computer data bus technology may be used to connect all of the tables to CPU 100. In this way, CPU 100 may be efficiently used to operate multiple games.

A certain event must be predetermined in the present invention to trigger or start the random jackpot process. In the embodiment described herein, this event is the occurrence of an Ace and a 10 value card (10, Jack, Queen, or King) in the first two cards dealt to the player. This combination, in the game of blackjack is called a "blackjack" and in the instance of such a combination of cards being shown by a player, the random prize selection process may be activated in the CPU 100. The process may be activated by a number of different activation means. In the preferred embodiment, the activation means comprises a switch or button 84 with connecting wire 86. Button 84 may include a flexible cord for allowing the button to be placed in from of each player. Other activation means may include a lever arm, as on a slot machine, or a pull cord hanging from above the table. One of the advantages of the present invention is that it encourages player participation and builds excitement. By pushing a button or pulling a lever arm, the player is allowed to physically activate the random selection process. This builds interest and excitement in the game and attracts new players to the game.

It should be emphasized that the predetermined combination of cards discussed in detail here is simply one predetermined condition which could be used to initiate the random prize selection process. A non-winning combination of cards, in certain orders perhaps, could be used as a "consolation" trigger of the prize selection process. A joker or other type of valueless card could be placed in the deck to initiate the process. It should also be noted that the present invention should in no way be considered as limited to the game of "21" Games such as poker, baccarat (being similar to "21" in playing mechanics), and electronic games may be used with the present invention. Of course, electronic games do not require dealers and activation means. It is only necessary that a predetermined event be decided on before the game is started.

In an alternative embodiment, a player is given the option of placing multiple side or prize wagers, each wager representing a different predetermined event. For example, a player could wager on the occurrence of a blackjack of any suit as well as a blackjack of the same suit.

Figure 2:
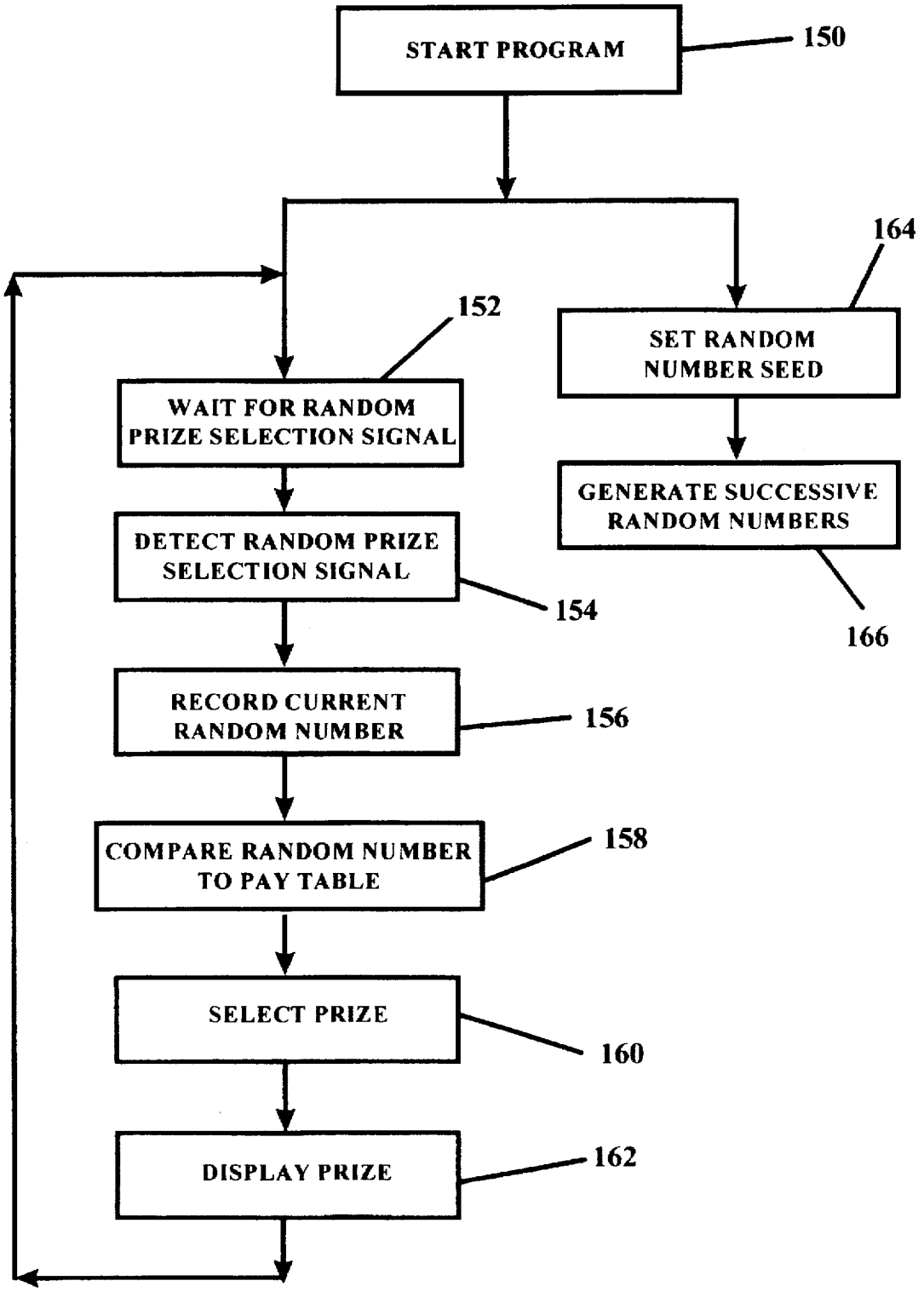
FIG. 2 is a flow chart describing the random selection algorithm of the present invention.

The discussion now turns to the random prize selection routine of the herein described embodiment. As seen in FIG. 2, the present invention comprises a random prize selection method which may be embodied in a computer software program in CPU 100. The method may begin at start program 150 which may include executing the program in CPU 100. The computer would then set a random number seed 164 for the random number generator portion of the method. Numerous random number generating techniques and seeds for initializing the random number generators are well known in the art. In the preferred embodiment of the present invention, the date and time supplied by the internal clock are used as seeds for the random number generator. Once the random number seed is set, the random number generator continuously and successively generates random numbers 166. The random number generation continues while the program performs other tasks and functions.

While the random number generator is generating random numbers, CPU 100 may wait for a random prize selection signal 152. This would correspond in the game to periods during which the dealers dealing cards and play of the underlying game proceeds as normal. Once the predetermined event has occurred, the player or dealer would activate a random prize selection signal which would may be generated by switch 84, as seen in FIG. 1. The signal would be transmitted to CPU 100 by wire means 86. Once the selection signal is generated, the CPU 100 detects the random prize selection signal 154. At this instant, the program records the current random number 156 generated by the random number generator. The recorded random number is then compared to a pay table 158. From the comparison, a prize is selected 160 from the pay table. The prize may then be displayed 162 for the player and the dealer to see. After the prize is displayed, the program may return to a state in which it is waiting for the random prize selection signal 152.

In the preferred embodiment, the random number generator generates an integer between one and 10,000. A typical pay table may appear as follows:

TABLE 1

| Payouts (10,000 total) | Probability | Prize Amount | Payable Index |
|---|---|---|---|
| 1 | 0.0000012066 | 10,000 | 1 |
| 249 | 0.0030044340 | 100 | 2–250 |
| 750 | 0.0009049500 | 50 | 251–1,000 |
| 1,000 | 0.0012066000 | 25 | 1,001–2,000 |
| 1,500 | 0.0018099000 | 20 | 2,001–3,500 |
| 2,500 | 0.0030166500 | 15 | 3,501–6,000 |
| 4,000 | 0.0048264000 | 10 | 6,001–10,000 |

The probabilities listed above include the probability of a player getting a blackjack as well as the odds of the prize amount occurring. It should be emphasized here that the probabilities are approximate. Other ranges of random numbers could also be generated, and various other weighting could be used to vary the amount of a winning jackpot. Practitioners could, with calculation, determine the pay out ratio that they would wish to maintain over time. The CPU, in the present invention, would preferably be of the common PC type, and thus would be easily programmable and re-programmable to allow the user to provide for varying conditions, such as special promotional jackpots, pies, and the like. Indeed, it should be noted that the jackpot prize not necessarily be cash: cars, vacation trips, accommodations, restaurant vouchers and other types of gratuities could be offered.

In the present invention, the prize selection mechanism is performed by CPU 100. However, it is recognized that other prize selection means may be used. For example, an electronically controlled spinning wheel with indicator means could be used to select the prize.

When the program has determined the amount of the prize to be awarded, it is shown at the randomly generated prize display 90 in FIG. 1. This is connected to the CPU 100 by connection wire means 92. In the embodiment described herein, the display means is an LCD or similar type display mounted on or suspended over the gaming table. Other locations and configurations would, of course, be obvious to a skilled artisan. The display could be a wall-mounted video screen and could be further enhanced by sound generation means when a large prize is one, thus attracting attention from other patrons of the gaming establishment. In a similar way, flashing lights could be utilized to draw attention to the winner and the amount won.

Though wire connections are discussed in the embodiment described herein, and shown in FIG. 1, it should be noted that other communication means between the table, the dealer, and the CPU could be utilized. Remote control type technology, using pulsed IR could easily be modified to fit the present invention. Although CPU 100 is shown as separate from gaming table 12, it could, of course, be obvious to design the table with the CPU built into the table.

Figure 3:
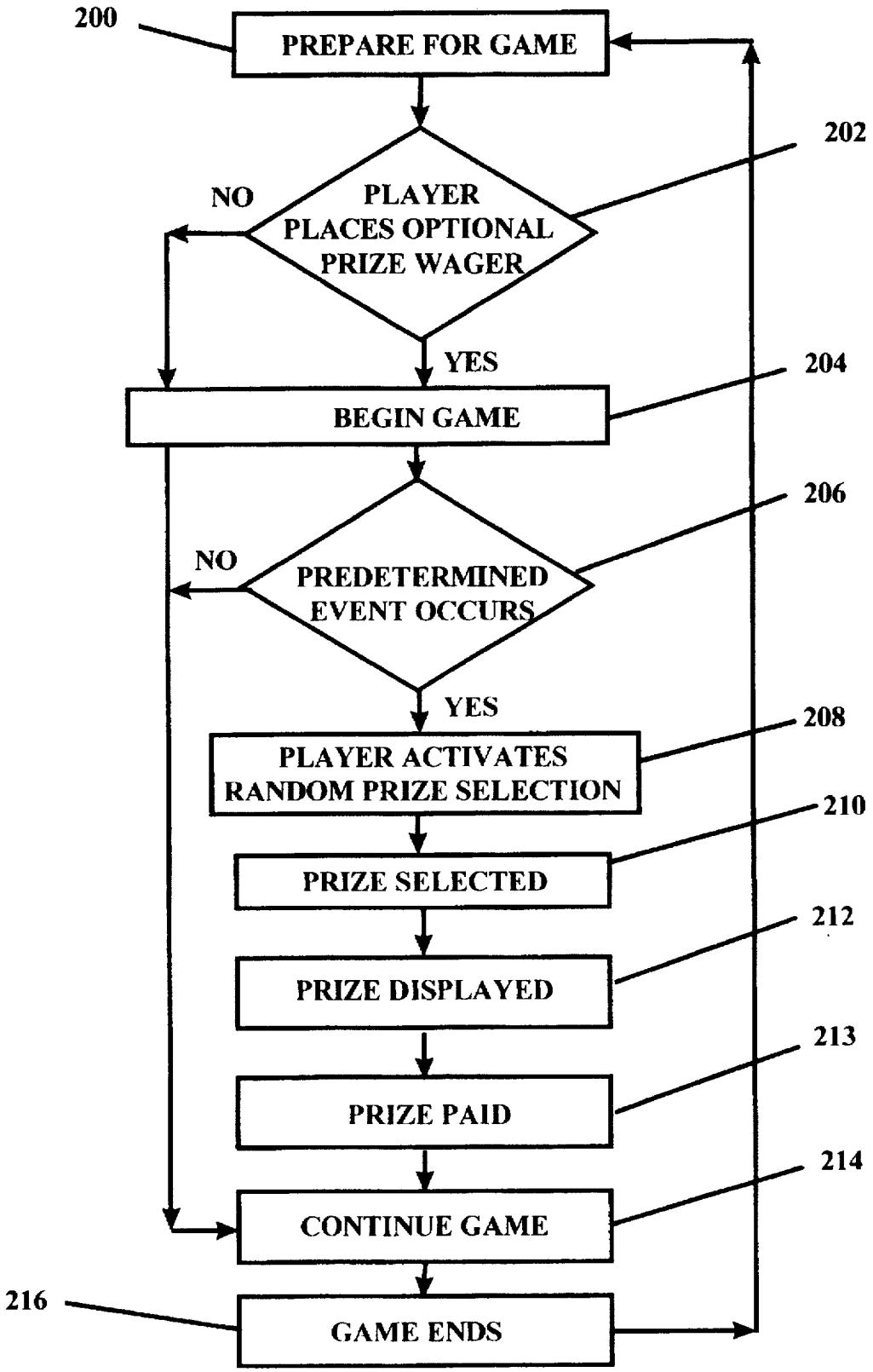
FIG. 3 is a flow chart describing the method of play of one embodiment of the present invention.

FIG. 3 describes the method of the present invention from the perspective of the dealer and the player. The dealer and the player first prepare to play the game 200. This step may include clearing the table of cards and wagers from previous games and players would also place wagers to participate in a new game. At this point, each player would have the option of placing an optional prize wager or side wager 202. This side wager allows the player to participate in the random prize selection of the present invention. The dealer would then begin the underlying game 204 as it would normally be played. In the game of blackjack, the dealer would deal two cards to each player and two cards to himself. The game would then continue as it normally would until a predetermined event occurred 206. In the preferred embodiment, wherein the game of blackjack is the underlying game, a blackjack is the predetermined event.

If the predetermined event occurs, the player or the dealer may activate the random prize selection 208. This may be done by depressing button or switch 84 in FIG. 1. In the present invention, CPU 100 performs a random prize selection algorithm which selects a prize 20 from a pay table. The prize is then displayed 212 on display means 90 and the prize 20 is paid 213. At this point, the underlying game may continue to be played in its normal manner 214. Eventually, the game would reach an end 216, and the entire process may be repeated.

It is apparent from the above that the present invention accomplishes all of the objectives set forth by providing a new and improved method and apparatus for generating large random prizes on live card tables and video screens that would increase the enjoyment of the players of these games and would generate additional excitement and revenue in the gaming entertainment industry.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

SUMMARY

To achieve the foregoing and other advantages, the present invention, briefly described, provides an apparatus and method to randomly select jackpots or prizes for live card games such as blackjack as well as electronic games. A side wager is placed in a receptacle or designated area which indicates to the dealer that the player wishes to participate in the random jackpot selection. If a predetermined event occurs during the course of the underlying game, such as the player being dealt a preselected combination of cards, the dealer or player may activate the random selection process device. The prize may be money, a tangible good, or a service. The jackpot or prize may be displayed on or near the gaming table. The player is then awarded the random jackpot amount.

The selected card combinations, combined with the generated random prizes of varying values, provides for a very low probability of a large jackpot occurrence. On the other hand, the present invention seeks to provide for a sufficient number of small jackpots to occur on a frequent enough basis, such that player interest is maintained and that new players are attracted to the game.

What is claimed is:

1. A method of playing a wagering game comprising the following steps:

(A) a player placing a prize wager, (B) playing an underlying game, the underlying game being capable of producing a predetermined event, (C) if the predetermined event occurs during the underlying game, then randomly selecting a prize from a predetermined set of prizes, and (D) awarding the prize to the player, whereby the underlying game may be enhanced by providing an opportunity for the player to win a randomly selected prize in the playing of the underlying game.

2. The method of claim 1 wherein the underlying game is a card game.

3. The method of claim 2 wherein the underlying game is blackjack.

4. The method of claim 3 wherein the predetermined event is a blackjack hand being dealt.

5. The method of claim 4 wherein the predetermined event is the player receiving the blackjack hand.

6. The method of claim 1 wherein the underlying game is an electronic game.

7. The method of claim 1 wherein the prize is a monetary sum.

8. The method of claim 1 wherein the prize is a good or service.

9. An apparatus for use with a wagering game, the game being capable of producing a predetermined event, the apparatus comprising:

(A) random selection means for randomly selecting a prize from among a set of predetermined prizes, (B) activation means for activating said random selection means when the predetermined event occurs, and (C) display means for displaying the randomly selected prize, whereby the game is enhanced by allowing a player to win the randomly selected prize during the play of the wagering game.

10. The apparatus of claim 9 wherein said random selection means comprises a computer.

11. The apparatus of claim 10 wherein said computer comprises:

(A) random number generating means for generating a random number and (B) memory means for storing a predetermined pay table, whereby said computer may generate a random number and select a prize by comparing the random number to the pay table.

12. The apparatus of claim 10 further comprising sensing means for sensing wagers made by the player, whereby said computer may record and monitor wagers made by the player.

13. The apparatus of claim 9 wherein said display means is an electric sign.

14. The apparatus of claim 10 wherein said activation means is an electric switch, whereby said electric switch transmits a signal to said computer.

15. A method of playing a wagering game comprising the following steps:

(A) giving a player an option to place a prize wager, (B) playing an underlying game, the underlying game being capable of producing a predetermined event, (C) if the predetermined event occurs and the player placed a wager on the prize wager, generating a random number, (D) selecting a prize from a predetermined pay table by comparing the random number to the pay table, the pay table having a set of predetermined prizes corresponding to ranges of possible random numbers, and (E) awarding the prize to the player, whereby the underlying game may be enhanced by allowing the player to win a randomly selected prize in the playing of the underlying game.

16. The method of claim 15 wherein generating a random number comprises the following steps:

(A) producing random numbers consecutively in a continuous manner and (B) recording one random number when the predetermined event occurs, whereby the recorded random number is used in selecting the prize.

* * * * *

US005707285C1

(12) REEXAMINATION CERTIFICATE (4619th)

United States Patent

Place et al.

(10) Number: US 5,707,285 C1

(45) Certificate Issued: Jul. 23, 2002

(54) METHOD AND APPARATUS FOR RANDOM PRIZE SELECTION IN WAGERING GAMES

(75) Inventors: Vaughn Place, 1120 E. Crystal Canyon Ct., Reno, NV (US) 89505; Brad Johnson, 6034 Plumas St., Apt. F, Reno, NV (US) 89509

(73) Assignees: Vaughn Place; Brad Johnson, both of Reno, NV (US)

Reexamination Request:
No. 90/005,707, Apr. 24, 2000

Reexamination Certificate for:

| | |
|---|---|
| Patent No.: | **5,707,285** |
| Issued: | **Jan. 13, 1998** |
| Appl. No.: | **08/761,492** |
| Filed: | **Dec. 6, 1996** |

Related U.S. Application Data

(60) Provisional application No. 60/014,657, filed on Apr. 2, 1996.

(51) Int. Cl.[7] ..... A63F 1/00; A63F 9/24

(52) U.S. Cl. ..... 463/12; 463/25; 273/292

(58) Field of Search ..... 463/1, 9–13, 16, 463/20, 25–27, 29, 30, 40, 42; 700/91, 93; 273/292, 309, 138.1, 138.2, 139

(56) References Cited

U.S. PATENT DOCUMENTS

| | | | | |
|---|---|---|---|---|
| 5,098,107 A | * | 3/1992 | Boylan et al. | 273/292 |
| 5,393,067 A | * | 2/1995 | Paulsen et al. | 273/292 |
| 5,743,800 A | | 4/1998 | Huard et al. | 463/26 |
| 5,770,533 A | * | 6/1998 | Franchi | 463/20 |

FOREIGN PATENT DOCUMENTS

| | | | |
|---|---|---|---|
| GB | 2191030 A | * | 12/1987 |
| GB | 2201821 A | * | 9/1988 |

* cited by examiner

*Primary Examiner*—Mark Sager

(57) ABSTRACT

A wagering game apparatus and method is provided which permits the random selection of prizes for games such as blackjack, poker, and electronic games. A side wager is placed in a receptacle or designated area which indicates to the dealer that the player wishes to participate in the random jackpot selection portion of the game. If a random event occurs, such as the player being dealt a preselected combination of cards, the player or dealer may activate the random prize selection process. The random prize selection is performed by a computer which uses a random generated number to select a prize from a pay table. The prize may be displayed on or near the gaming table. The player is then awarded the random jackpot amount.

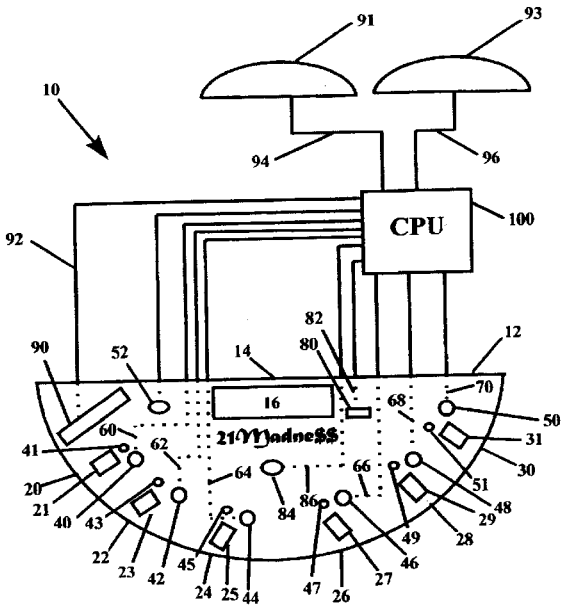

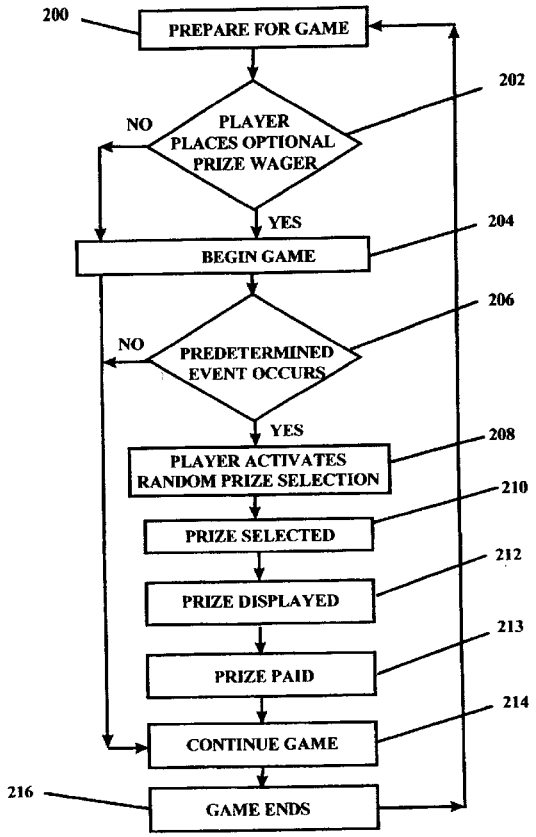

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2 and 6 are cancelled.

Claims 1, 3, 9 and 15 are determined to be patentable as amended.

Claims 4–5, 7–8, 10–14 and 16, dependent on an amended claim, are determined to be patentable.

New claims 17–33 are added and determined to be patentable.

1. A method of playing a *live card* wagering game comprising the following steps:

(A) a player placing a prize wager, (B) playing an underlying *live card* game, the underlying *live card* game capable of producing a predetermined event, (C) if the predetermined event occurs during the underlying *live card* game, then randomly selecting a prize from a predetermined set of prizes, and (D) awarding the prize to the player, whereby the underlying *live card* game may be enhanced by providing an opportunity for the player to win a randomly selected prize in the playing of the underlying *live card* game.

3. The method of claim [2] *1*, wherein the underlying *live card* game is blackjack.

9. An apparatus for use with a *live card* wagering game, the *live card* game being capable of producing a predetermined event, the apparatus comprising:

(A) random selection means for randomly selecting a prize from among a predetermined set of prizes, (B) activation means for activating said random selection means when the predetermined event occurs, and (C) display means for displaying the randomly selected prize, whereby the *live card* game is enhanced by allowing a player to win the randomly selected prize during the playing of the [wagering] *live card* game.

15. A method of playing a *live card* wagering game comprising the following steps:

(A) giving a player an option to place a prize wager, (B) playing an underlying *live card* game, the underlying *live card* game being capable of producing a predetermined event, (C) if the predetermined event occurs and the player placed a wager on the prize wager, generating a random number, (D) selecting a prize from a predetermined pay table by comparing the random number to the pay table, the pay table having a set of predetermined prizes corresponding to a range of possible random numbers, and (E) awarding the prize to the player, whereby the underlying *live card* game may be enhanced by allowing the player to win a randomly selected prize in the playing of the underlying *live card* game.

*17. A method of playing a live card game comprising the following steps:*

*(A) a player placing a prize wager;*

*(B) playing an underlying live card game, the underlying live card game being capable of producing a predetermined event;*

*(C) if the predetermined event occurs during the underlying live card game, then randomly selecting a prize from a predetermined pay table of distinct prizes; and*

*(D) awarding the prize to the player, whereby the underlying live card game may be enhanced by providing an opportunity for the player to win a randomly selected prize in the playing of the underlying live card game.*

*18. The method of claim 17, wherein the underlying live card game comprises blackjack.*

*19. The method of claim 18 wherein the predetermined event comprises a blackjack hand being dealt.*

*20. The method of claim 19 wherein the predetermined event comprises the player receiving the blackjack hand.*

*21. The method of claim 17 wherein the underlying game comprises an electronic game.*

*22. The method of claim 17 wherein the prize comprises a monetary sum.*

*23. The method of claim 17 wherein the prize comprises a good or service.*

*24. An apparatus for use with a live card game, the live card game being capable of producing a predetermined event, the apparatus comprising:*

*(A) random selection means for randomly selecting a prize from among a predetermined pay table of distinct bonus prizes;*

*(B) activation means for activating said random selection means when the predetermined event occurs; and*

*(C) display means for displaying the randomly selected bonus prize, whereby the live card game is enhanced by allowing a player to win the randomly selected bonus prize during the playing of the live card game.*

*25. The apparatus of claim 24 wherein the random selection device comprises a computer.*

*26. The apparatus of claim 25 wherein the computer comprises:*

*(A) a random number generating means for generating a random number; and*

*(B) a system for accessing a predetermined pay table, whereby the computer may generate a random number and select a prize by comparing the random number to the pay table.*

*27. The apparatus of claim 25 further comprising a sensing device adapted to sense wagers made by the player, whereby the computer may record and monitor wagers made by the player.*

*28. The apparatus of claim 24 wherein the display device is an electric display.*

*29. The apparatus of claim 25 wherein the activation device is an electric switch whereby the electric switch transmits a signal to said computer.*

*30. A method of playing a live card game comprising the following steps:*

*(A) giving a player an option to place a prize wager;*

*(B) playing an underlying live card game, the underlying live card game being capable of producing a predetermined event; and*

*(C) if the predetermined event occurs and the player placed the prize wager, then:*

(*a*) *recording a random number;*

(*b*) *selecting a prize from a predetermined pay table by comparing the random number to the pay table, the pay table having a list of predetermined distinct prizes corresponding to a range of possible random numbers; and*

(*c*) *awarding the prize to the player, whereby the underlying live card game may be enhanced by allowing the player to win a randomly selected prize in the playing of the underlying live card game.*

*31. The method of claim 30 wherein generating a random number comprises the following steps:*

(*A*) *producing random numbers consecutively in a continuous manner; and*

(*B*) *recording one random number when the predetermined event occurs, whereby the recorded random number is used in selecting the prize.*

*32. The method of claim 30 wherein a value of the prize is independent of a probability of occurrence of the predefined event.*

*33. The method of claim 30, wherein a value of the prize is independent of success in the underlying game.*

* * * * *